US009394732B1

(12) United States Patent
Ahmad

(10) Patent No.: US 9,394,732 B1
(45) Date of Patent: Jul. 19, 2016

(54) HANDS-FREE DOOR LATCH MECHANISM

(71) Applicant: Abdulaziz K H. M. A. A. Ahmad, Jaber Al Ali (KW)

(72) Inventor: Abdulaziz K H. M. A. A. Ahmad, Jaber Al Ali (KW)

( * ) Notice: Subject to any disclaimer, the term of this patent is extended or adjusted under 35 U.S.C. 154(b) by 0 days.

(21) Appl. No.: 14/956,332

(22) Filed: Dec. 1, 2015

(51) Int. Cl.

| | |
|---|---|
| ***E05C 1/10*** | (2006.01) |
| ***E05C 19/02*** | (2006.01) |
| ***E05C 1/02*** | (2006.01) |
| ***E05C 17/02*** | (2006.01) |
| ***E05C 19/06*** | (2006.01) |
| ***E05C 1/08*** | (2006.01) |
| ***E05B 85/22*** | (2014.01) |
| *E05C 1/00* | (2006.01) |

(52) U.S. Cl.
CPC ..... *E05C 19/028* (2013.01); *E05B 85/22* (2013.01); *E05C 1/02* (2013.01); *E05C 1/08* (2013.01); *E05C 1/085* (2013.01); *E05C 1/10* (2013.01); *E05C 17/02* (2013.01); *E05C 19/063* (2013.01)

(58) Field of Classification Search
CPC ..... E05B 85/22; E05C 1/08; E05C 1/085; E05C 1/10
USPC ..... 292/173, 175, 336.3, 150
See application file for complete search history.

(56) References Cited

U.S. PATENT DOCUMENTS

| | | | | | |
|---|---|---|---|---|---|
| 369,639 | A * | 9/1887 | Goodhue | G09F 13/34 | 40/459 |
| 590,418 | A * | 9/1897 | Langford | E05B 41/00 | 40/460 |
| 853,764 | A * | 5/1907 | Brown | E05B 65/0864 | 292/175 |
| 1,120,874 | A * | 12/1914 | Whitcomb | E05B 85/22 | 292/173 |
| 1,205,061 | A * | 11/1916 | Thull | E05B 65/0864 | 292/175 |
| 1,216,899 | A * | 2/1917 | Weyer | E05B 41/00 | 40/460 |
| 1,337,401 | A * | 4/1920 | Heberling | E05B 41/00 | 40/460 |
| 1,347,799 | A * | 7/1920 | Wilkins | E05C 1/10 | 292/175 |
| 1,474,575 | A * | 11/1923 | Ainsworth | E05B 65/0007 | 292/202 |

(Continued)

FOREIGN PATENT DOCUMENTS

DE 2518819 11/1976

OTHER PUBLICATIONS

Website, http://www.ebay.com/itm/slide-bolt-door-latch-lock-stainless-steel-press-open-3-1-4-/1110174551, Slide Bolt Door Latch Lock, two sheets printed from the Internet on Jul. 27, 2015.

*Primary Examiner* — Carlos Lugo
(74) *Attorney, Agent, or Firm* — Richard C. Litman

(57) ABSTRACT

The hands-free door latch mechanism includes two mutually opposed actuator plates to each side of the door, with the plates disposed vertically and orthogonally to the plane of the door. The plates are rigidly connected, with the connector bar also rigidly connected to the latch of the door. When either plate is pushed toward the hinge line of the door, the connector draws the latch into the door to release the latch from the strike plate. A horizontally disposed lock plate extends from one side of the door, with a transverse lock rod extending through the door. The lock rod has a tang that resides above the internal end of the latch when unlocked. When the lock plate is pushed down, the tang drops behind the latch to prevent retraction of the latch. The opposite end of the lock rod has a lock status indicator extending therefrom.

20 Claims, 6 Drawing Sheets

(56) References Cited

U.S. PATENT DOCUMENTS 1,724,116 A * 8/1929 Swearengin ..... E05C 1/10 292/145
1,786,521 A * 12/1930 Dermody ..... E05B 55/00 292/150
2,118,722 A * 5/1938 Bock ..... E05F 13/02 16/285
2,178,378 A * 10/1939 Schlage ..... E05C 1/16 292/173
2,230,599 A * 2/1941 O'Connor ..... E05B 65/025 292/19
2,238,513 A * 4/1941 Ward ..... E05B 1/0053 16/412
2,263,477 A * 11/1941 Voight ..... E05C 1/163 292/150
2,272,909 A * 2/1942 Fantl ..... E05B 41/00 116/202
2,364,795 A * 12/1944 Koehler ..... E05C 1/12 16/412
2,379,326 A * 6/1945 Voight ..... E05B 1/0053 292/173
2,423,988 A * 7/1947 Lickteig ..... E05C 1/163 292/150
2,547,108 A * 4/1951 Anderson ..... E05C 1/14 292/147
2,565,669 A * 8/1951 Smith ..... E05B 41/00 116/290
2,593,573 A * 4/1952 Kulbersh ..... E05C 1/163 292/150
2,970,856 A * 2/1961 Hansen ..... E05C 1/14 292/148
3,242,707 A * 3/1966 Kenaga ..... E05B 63/0017 292/150
3,304,756 A * 2/1967 Eads ..... E05B 41/00 116/80
3,318,123 A * 5/1967 Piazza ..... E05B 17/2042 292/150
3,374,020 A * 3/1968 Berg ..... E05C 1/10 292/148
3,391,674 A * 7/1968 Burleigh ..... A01K 1/035 119/174
3,477,754 A 11/1969 Check
3,648,411 A * 3/1972 Saunders ..... E05B 1/0015 16/412
3,688,531 A * 9/1972 Hawkins ..... E05B 63/20 292/165
3,765,709 A * 10/1973 Van Wyck ..... E05B 63/24 292/144
4,003,593 A 1/1977 Wilzig et al.
4,490,999 A * 1/1985 Castle ..... E05B 41/00 70/330
5,286,074 A * 2/1994 Lin ..... E05B 13/002 292/150
5,327,632 A * 7/1994 Moore ..... E05B 13/002 29/401.1
5,603,184 A * 2/1997 Campbell ..... E05B 15/10 292/145
6,139,072 A 10/2000 Lee
6,189,183 B1 * 2/2001 Hartselle, III ..... E05B 1/0015 16/412
6,293,598 B1 9/2001 Rusiana
7,258,374 B2 8/2007 Rusiana
7,571,694 B2 * 8/2009 Boerner ..... G08B 5/36 116/204
7,699,365 B2 * 4/2010 Liang ..... E05B 41/00 292/240
8,522,482 B2 * 9/2013 Buck ..... E05B 1/0069 16/320
8,579,338 B1 * 11/2013 Shah ..... E05C 1/04 292/1.5
8,720,116 B1 * 5/2014 Ahmad ..... E05B 17/2038 16/412
2004/0251694 A1 * 12/2004 Gorski ..... E05B 65/0007 292/175
2013/0076046 A1 3/2013 Shah et al.
2015/0145266 A1 5/2015 Song

* cited by examiner

HANDS-FREE DOOR LATCH MECHANISM

BACKGROUND OF THE INVENTION

1. Field of the Invention

The present invention relates generally to locks, latches, and similar mechanisms and devices, and particularly to a hands-free door latch mechanism including a hands-free lock mechanism.

2. Description of the Related Art

Doors with latches are conventionally equipped with knobs or sometimes levers, requiring those devices to be operated by hand in order to release the latch and open the door. This has been proven to be a generally acceptable and workable means for operating doors, but there are certain circumstances in which such hand-operated devices are not suitable.

For example, it is well known that viruses and bacteria are commonly carried on the hands due to hand contact with innumerable articles and interaction with other people, as when shaking hands. It has been established that this often leads to the transmission of various illnesses, e.g., colds, flu, etc., from person to person. One of the most common articles with which the hand may come in contact is the conventional doorknob, or perhaps lever. Such door latch actuating devices thus act as disease vectors, transmitting diseases from one person to another merely by the act of persons opening and closing the door by grasping the knob or lever. This is particularly critical in medical facilities such as hospitals, doctors' offices, and the like, where persons with lowered resistance may be receiving treatment.

In other cases, people often have their hands and arms full when arriving at a door that needs to be opened. The conventional knob, or even lever, requires that at least some of the load be put down so the person will have a free hand to operate the knob or lever. This is inefficient at best, and in many cases the load being carried must be placed on the ground where it is subject to soiling or other damage.

Various mechanisms providing for the hands-free opening or unlatching of a door have been developed in the past. An example of such is found in German Patent Publication No. 2,518,819 published on Nov. 11, 1976 to Martin Gabler. This reference describes (according to the drawings, English abstract, and machine generated English translation) a door latch assembly having a lever actuated pull handle on one side and a pushbutton on the opposite side. The pushbutton operates a rod that in turn pushes a lever within the handle to release the latch mechanism.

Thus, a hands-free door latch mechanism solving the aforementioned problems is desired.

SUMMARY OF THE INVENTION

The hands-free door latch mechanism includes a pair of mutually opposed actuator plates disposed to each side of the door near the latch edge of the door. The plates define vertically oriented major planes that are orthogonal to the plane of the door. Arms extend from the plates, with a connecting bar or rod extending across the arms to link the two arms and their plates rigidly together. The connecting bar or rod passes through one end of the latch in the door opposite the external striker end of the latch, thus connecting the latch rigidly to the two actuator plates. When either of the actuator plates is pushed toward the hinge line of the door, the latch is retracted accordingly, allowing the door to be opened.

A lock plate also extends laterally from one side of the door, with the lock plate having a horizontally disposed major plane. The lock plate extends from a transverse lock bar or rod that passes through the door. The lock bar or rod includes a depending tang disposed immediately behind the internal end of the latch. When the lock plate is raised, the internal end of the latch is free to move beneath the lock bar tang, thus allowing the latch to retract in order for the door to be opened. When the lock plate is lowered, the tang drops behind the internal end of the latch, thus preventing the retraction of the latch and opening of the door. The transverse lock bar extends through the opposite side of the door, with a lock status indicator extending from the end of the lock bar to inform persons of the status of the lock, i.e., either locked or unlocked from the lock plate on the opposite side of the door.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The hands-free door latch mechanism can be unlatched and opened from either side of the door, without requiring use of the hands. This allows users to unlatch and open the door, without being required to manipulate the door handle with their hands. This also reduces the risk of contamination due to the possibility of disease organisms disposed upon the door handle.

Figure 1:
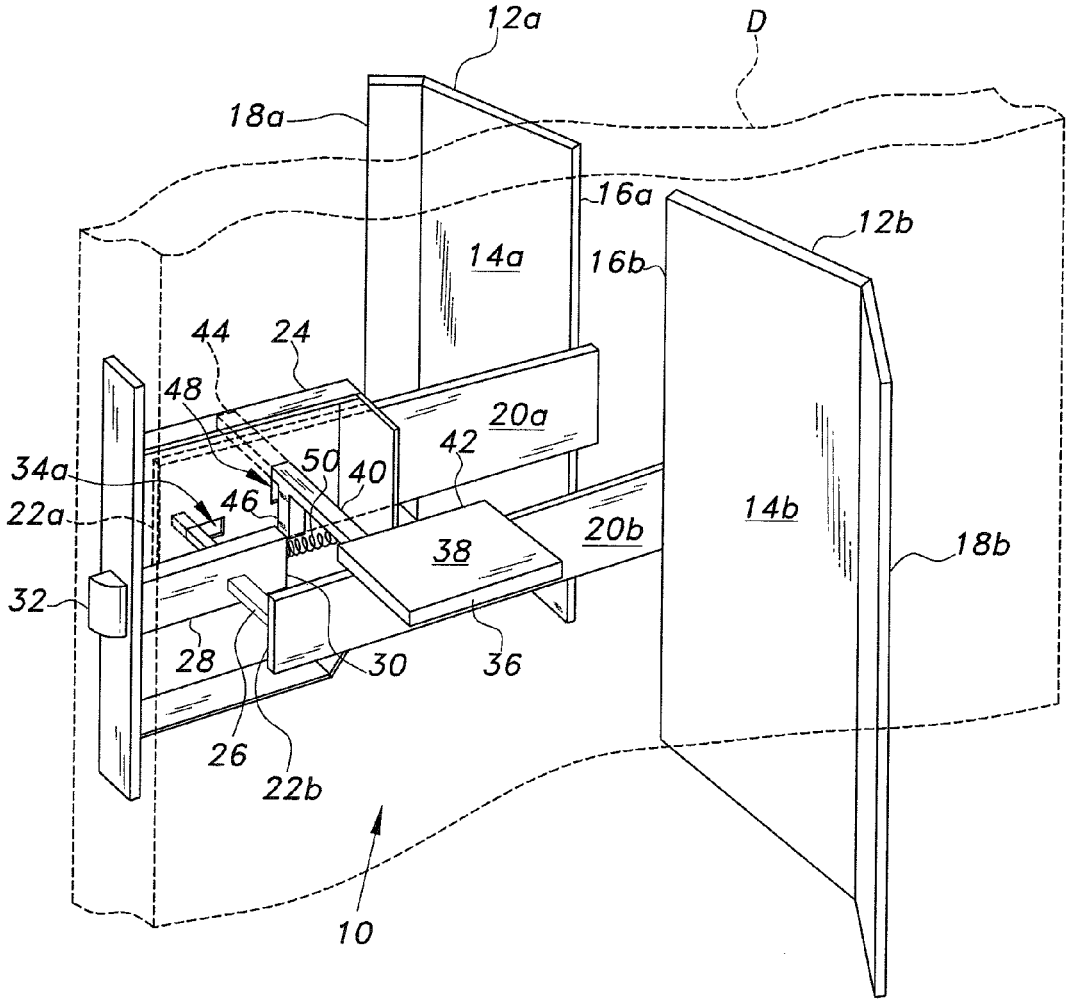
FIG. 1 is a perspective view of a hands-free door latch mechanism according to the present invention, illustrating its general features and relationships of components.

FIG. 1 provides a perspective view of most of the components of the hands-free door latch mechanism 10. The mechanism 10 includes mutually opposed, laterally disposed first and second latch actuator plates, respectively 12*a* and 12*b*, disposed to opposite sides or surfaces of a door D and extending toward the hinge edge of the door from the latch edge. The two plates 12*a*, 12*b* are coplanar, as can be seen in the top plan view of FIG. 2, and have substantially vertically oriented major planes, respectively 14*a* and 14*b*, and substantially vertically oriented inboard edges, respectively 16*a* and 16*b*. Each plate 12*a*, 12*b* includes an outer edge portion, respectively 18*a* and 18*b*, laterally opposite the respective inboard or inner edges 16*a*, 16*b*. These two outer edge portions 18*a*, 18*b* are bent or set at an angle relative to the planes 14*a*, 14*b* of the two actuator plates 12*a* and 12*b*. The outer edge portions 18*a*, 18*b* help to prevent the arm or elbow of a person from slipping past the outer edge of the actuator plate(s) 12*a* or 12*b* when using the mechanism 10.

Figure 2:
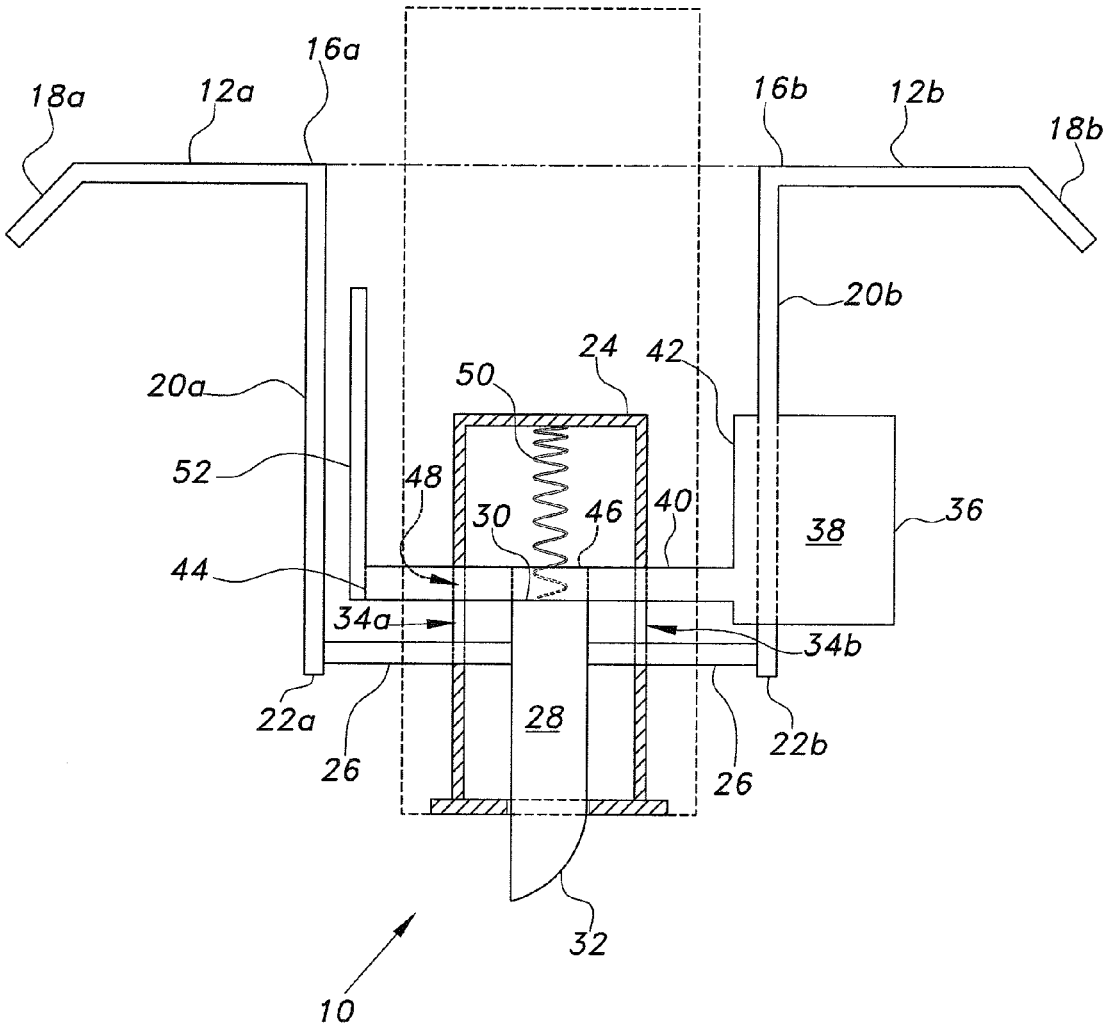
FIG. 2 is a top plan view of the hands-free door latch mechanism according to the present invention, illustrating further details thereof.

Mutually parallel first and second arms, respectively 20*a* and 20*b*, are rigidly affixed to and extend from the respective inboard edges 16*a* and 16*b* of the two actuator plates 12*a*, 12*b*. The two arms 20*a*, 20*b* can extend normal or substantially normal to the actuator plates 20*a* and 20*b*, respectively. The two arms 20*a*, 20*b* extend toward the latch edge of the door D, with their distal ends 22*a*, 22*b* disposed to the opposite sides of mortise box 24 installed within the door D. A transverse latch connecting rod 26 is rigidly affixed to and extends between the distal ends 22*a*, 22*b* of the two arms 20*a*, 20*b*, to connect the two arms 20*a*, 20*b* and their actuator plates 12*a*, 12*b* rigidly to one another. The connecting rod 26 passes through and is rigidly affixed to an elongate latch 28 disposed within the mortise box 24. The latch 28 has an inner end 30 within the mortise box 24, and a strike end 32 that selectively extends from the mortise box 24 to engage the strike plate disposed within the door frame (not shown). This assembly results in the latch 28, the connecting rod 26, the two arms 20*a* and 20*b*, and the two actuator plates 12*a* and 12*b* moving in unison with one another when any of these components is moved. Latch connecting rod slots 34*a* and 34*b* (both are shown in FIG. 2) provide clearance for movement of the latch connecting rod 26 when the actuator plates 12*a*, 12*b* and attached components are moved to unlatch the door.

The hands-free door latch mechanism 10 further provides for locking the latch from one side of the door. A lock plate 36 having a substantially horizontally disposed major plane 38 (shown in edge view in the elevation views of FIGS. 3A through 4A) extends laterally from one side of the door D, with a transverse lock rod 40 extending from the inner edge 42 of the lock plate 36 through the mortise box 24 and the door D, with a distal end 44 opposite the lock plate 36 disposed externally to the mortise box 24 and the door D. A tang 46 depends generally medially from the lock rod 40, with the tang 46 selectively communicating with the latch 28. More specifically, the lock rod 40 can move vertically in the mortise box 24 and door D, as shown by the vertical lock rod slot 48 disposed in the side of the mortise box 24 in FIG. 1.

Figure 3A:
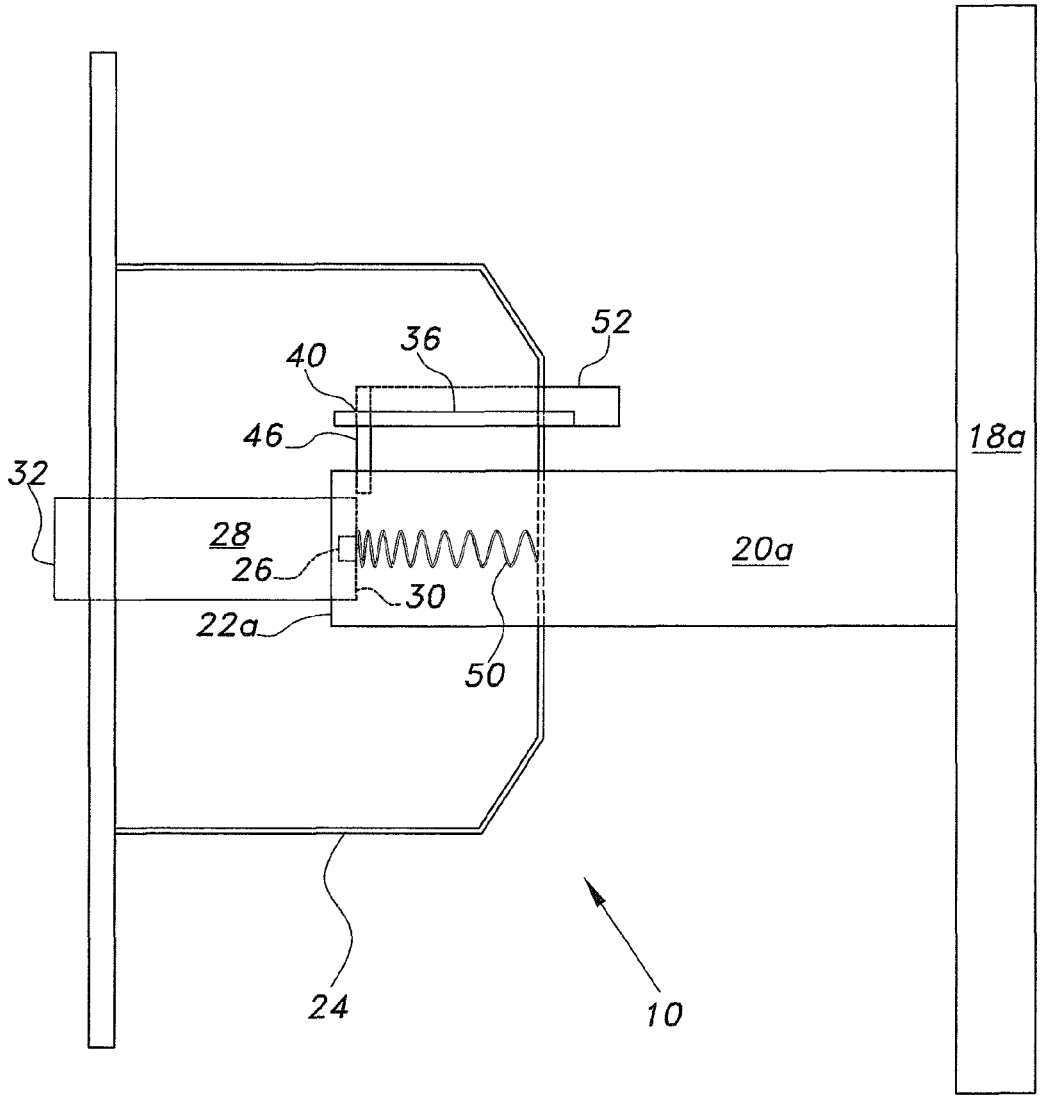
FIG. 3A is a side elevation view of the hands-free door latch mechanism according to the present invention, showing the latch extended and the mechanism in an unlocked state.
Figure 3B:
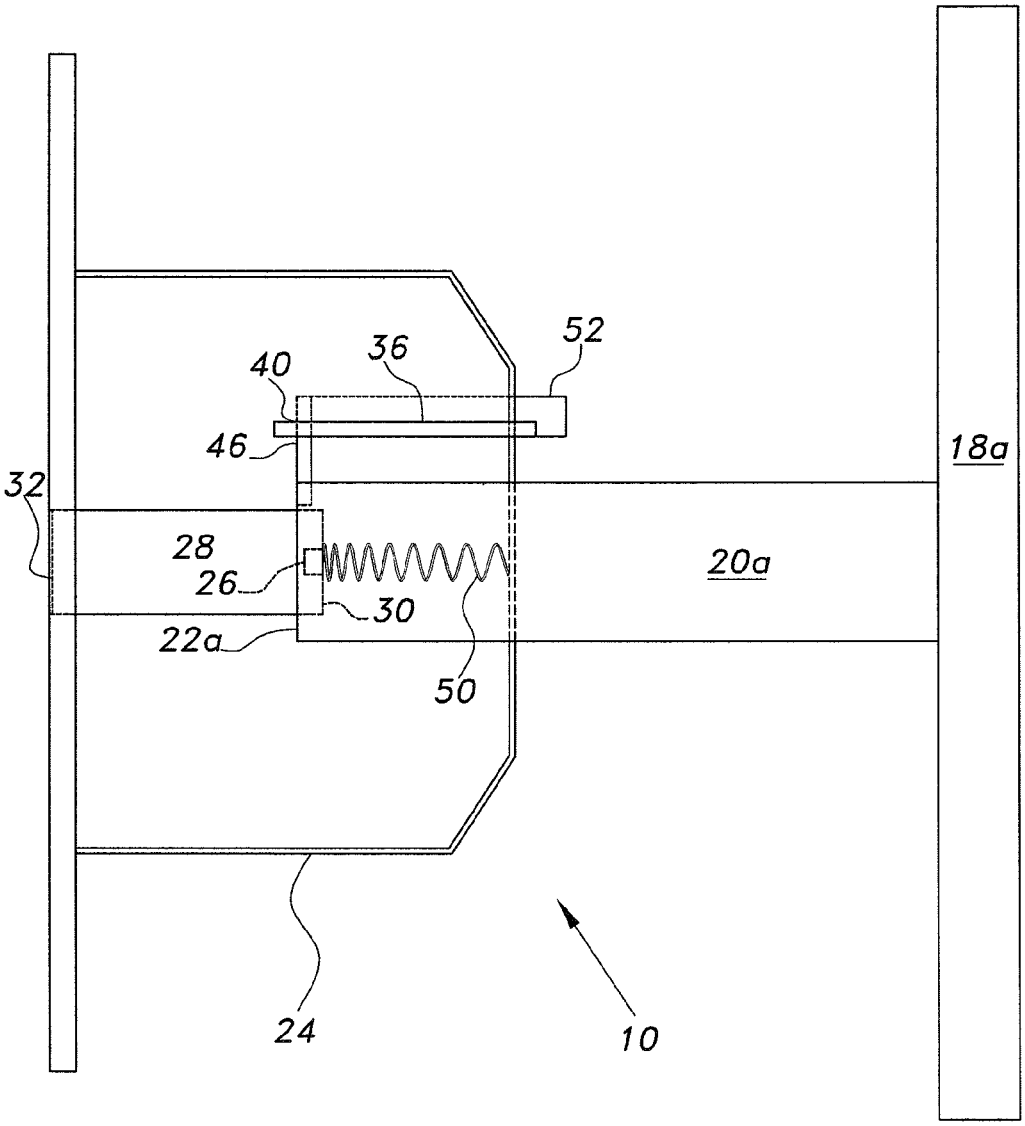
FIG. 3B is a side elevation view of the hands-free door latch mechanism according to the present invention, showing the latch retracted by operation of the hands-free actuator plate.

When the lock plate 36 is in its raised position as shown in FIGS. 1, 3A, and 3B, the lower end of the tang 46 is positioned just above the top of the latch 28, allowing the latch 28 to extend and retract freely in the mortise box 24. A detent, not shown, may be provided to hold the lock rod 40 in its raised position to allow the latch 28 to move freely beneath the tang 46. A compression spring 50 is disposed between the back of the mortise box 24 and the inner end 30 of the latch 28, to bias or urge the latch 28 to its extended position as shown in FIGS. 1, 2, and 3A. The latch 28 may be retracted against the pressure of the spring 50, as shown in FIG. 3B, by pushing either of the two actuator plates 12*a* or 12*b* away from the strike edge of the door D due to the rigid assembly of the actuator plates 12*a* and 12*b*, their arms 20*a* and 20*b*, and the latch connecting rod 26 that extends between the two arms 20*a*, 20*b* and passes through the latch 28.

Figure 4A:
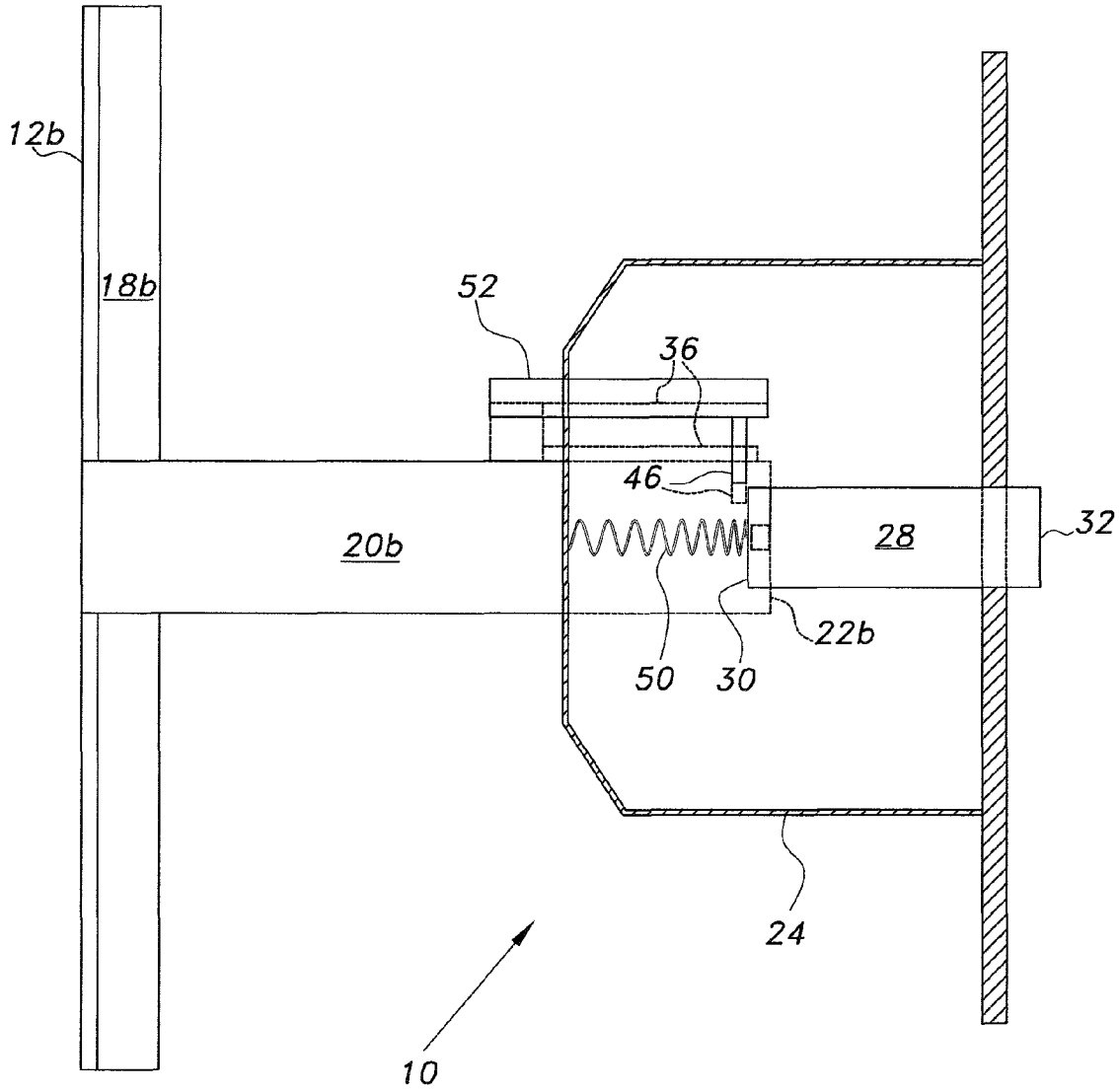
FIG. 4A is a side elevation view of the hands-free door latch mechanism according to the present invention from the opposite side of the views of FIGS. 3A and 3B, showing the operation of the lock mechanism therein.

However, when the latch 28 is in its normally extended position as shown in FIGS. 1 through 3A, the lock plate 36 may be pressed downward to lower the lock rod 40 and thus its tang 46 behind the inner end 30 of the latch 28, as shown in broken lines in FIG. 4A. It will be seen that in this configuration that the latch 28 cannot be retracted to allow the door D to open, due to the retraction of the latch 28 being blocked by the lowered tang 46. When the lock plate 36 is raised, the tang 46 is also lifted to clear the inner end 30 of the latch 28, allowing the latch 28 to be retracted by operation of either of the actuator plates 12*a*, 12*b* to allow the door D to be opened.

Figure 4B:
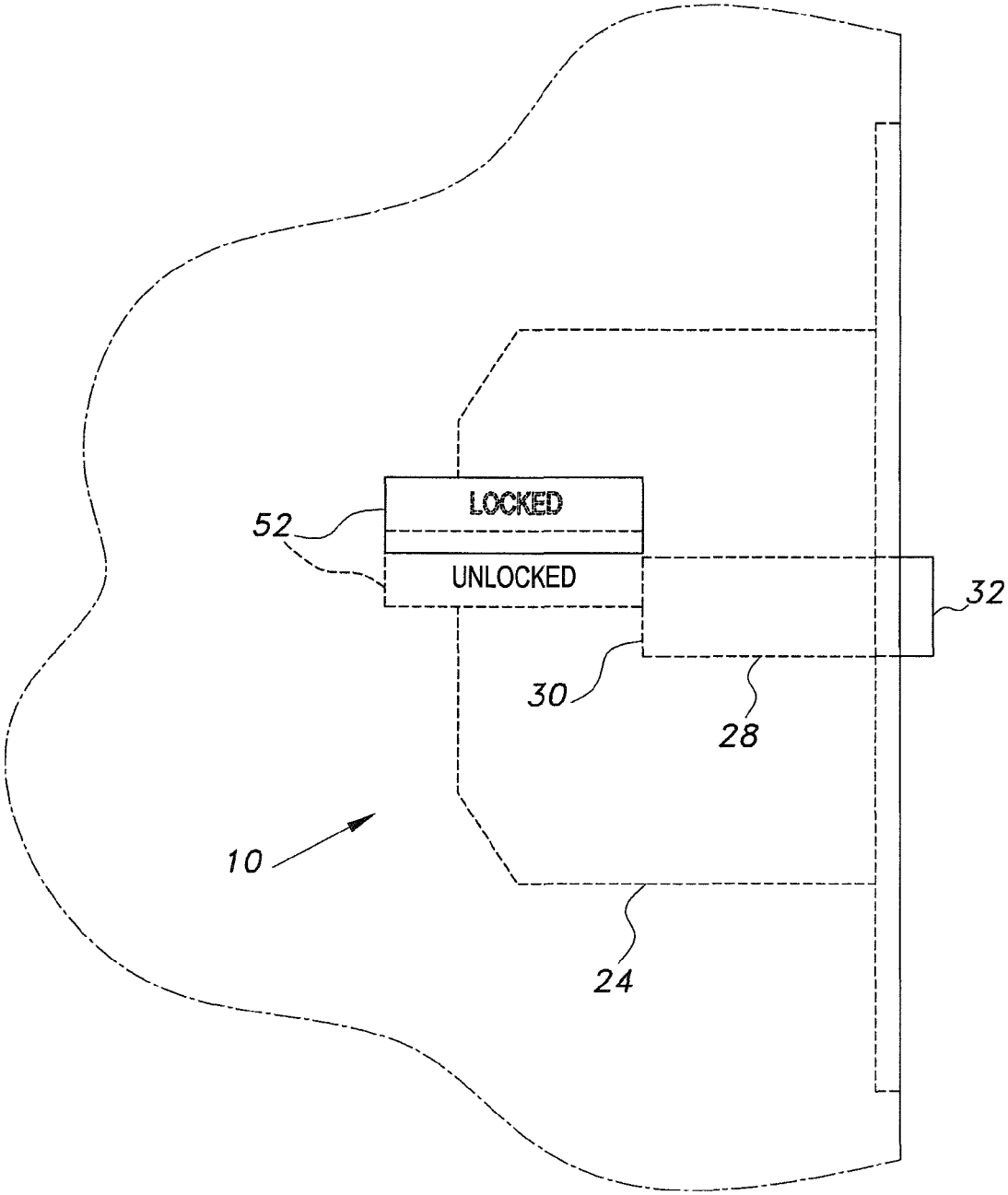
FIG. 4B is an environmental side elevation view of the hands-free door latch mechanism according to the present invention, showing the mechanism installed in a portion of a door to show the operation of the lock status flag.

A lock status indicator 52 extends from the distal end 44 of the lock rod 40, externally to the mortise box 24 and door D. The lock status indicator 52 is a flat plate having a substantially vertical major plane orthogonal to the plane defined by the two actuator plates 12*a* and 12*b*, as shown in FIG. 2. It will be seen that the lock status indicator 52 moves upward and downward in unison with vertical movement of the lock plate 36 and its lock rod 40 and tang 46. The upper and lower positions of the lock status indicator 52 can be used to indicate the status of the lock mechanism as set by the lock plate 36 from the opposite side of the door D, depending upon whether the latch 28 has been locked by the tang 46 or not. In FIG. 4B, the lock status indicator 52 is shown in its raised or unlocked position in solid lines, exposing the word "UNLOCKED" therebelow. However, when the lock plate 36 on the opposite side of the door D from the lock status indicator 52 is pushed down to lower the tang 46 and lock the latch 28, the lock status indicator 52 is also lowered, as shown in broken lines in FIG. 4B. This exposes the word "LOCKED" above the lowered lock status indicator 52, as shown in broken lines in FIG. 4B. The specific word or symbol used to indicate the locked or unlocked status of the mechanism 10 is not critical. Other words or symbols conveying the lock status may be used as desired.

It is to be understood that the present invention is not limited to the embodiments described above, but encompasses any and all embodiments within the scope of the following claims.

I claim:

1. A hands-free door latch mechanism, comprising:

mutually opposed, laterally disposed first and second actuator plates, the actuator plates having vertically oriented major planes and inboard edges, the planes being mutually coplanar;

a first arm and a second arm extending from the inboard edge of the respective first actuator plate and second actuator plate, each arm having a distal end, the arms being parallel to one another;

a transverse connecting rod extending between the distal ends of the arms;

a latch having a strike end and an inner end opposite the strike end, the latch being attached to the connecting rod between the arms;

a lock plate, the lock plate having a substantially horizontal major plane and an inner edge, the lock plate selectively communicating with the latch;

a transversely disposed lock rod extending from the inner edge of the lock plate, the lock rod having a distal end opposite the lock plate; and a tang depending generally medially from the lock rod, the tang selectively engaging the inner end of the latch and preventing latch movement when the lock plate is shifted downward.

2. The hands-free door latch mechanism according claim 1, wherein the first and second arms extend normal to the first and second actuator plates.

3. The hands-free door latch mechanism according claim 1, further comprising a mortise box, the inner end of the latch disposed within the mortise box.

4. The hands-free door latch mechanism according claim 1, wherein each actuator plate includes an outer edge portion opposite the inboard edge, each outer edge portion disposed at an angle to the major plane of the actuator plate.

5. A hands-free door latch mechanism, comprising:

mutually opposed, laterally disposed first and second actuator plates, the actuator plates having vertically oriented major planes and inboard edges, the planes being mutually coplanar:

a first arm and a second arm extending from the inboard edge of the respective first actuator plate and second actuator plate, each arm having a distal end, the arms being parallel to one another;

a transverse connecting rod extending between the distal ends of the arms;

a latch having a strike end and an inner end opposite the strike end, the latch being attached to the connecting rod between the arms;

a lock plate, the lock plate having a substantially horizontal major plane and an inner edge, the lock plate selectively communicating with the latch;

a transversely disposed lock rod extending from the inner edge of the lock plate, the lock rod having a distal end opposite the lock plate; and a lock status indicator extending from the distal end of the lock rod, the lock status indicator having a substantially vertical major plane substantially orthogonal to the major planes of the actuator plates, the lock status indicator shifting in unison with the lock plate and indicating lock status accordingly.

6. The hands-free door latch mechanism according claim 5, wherein the first and second arms extend normal to the first and second actuator plates.

7. The hands-free door latch mechanism according claim 5, further comprising a mortise box, the inner end of the latch disposed within the mortise box.

8. The hands-free door latch mechanism according claim 5, wherein each actuator plate includes an outer edge portion opposite the inboard edge, each outer edge portion disposed at an angle to the major plane of the actuator plate.

9. A hands-free door latch mechanism, comprising: at least one actuator plate having an inboard edge;

an arm rigidly attached to and extending from the inboard edge of the actuator plate, the arm having a distal end;

a transverse connecting rod rigidly affixed to the distal end of the arm;

a latch having a strike end and an inner end opposite the strike end, the latch being rigidly affixed to the connecting rod generally medially thereto;

a lock plate, the lock plate having a substantially horizontal major plane and an inner edge, the lock plate selectively communicating with the latch;

a transversely disposed lock rod extending from the inner edge of the lock plate, the lock rod having a distal end opposite the lock plate; and a tang depending generally medially from the lock rod, the tang selectively engaging the inner end of the latch and preventing latch movement when the lock plate is shifted downward.

10. The hands-free door latch mechanism according claim 9, further comprising:

mutually opposed, laterally disposed first and second actuator plates, the actuator plates having vertically oriented major planes, the planes being mutually coplanar; and a first arm and a second arm extending from the inboard edge of the respective first actuator plate and second actuator plate, the arms being parallel to one another, the connecting rod extending between the distal ends of the arms, the latch being attached to the connecting rod between the arms.

11. The hands-free door latch mechanism according claim 9, further comprising a mortise box, the inner end of the latch disposed within the mortise box.

12. The hands-free door latch mechanism according claim 9, wherein each actuator plate includes an outer edge portion opposite the inboard edge, each outer edge portion disposed at an angle to the major plane of the actuator plate.

13. A hands-free door latch mechanism, comprising:

at least one actuator plate having an inboard edge;

at least one arm rigidly attached to and extending from the inboard edge of the actuator plate, the arm having a distal end;

a transverse connecting rod rigidly affixed to the distal end of the arm;

a latch having a strike end and an inner end opposite the strike end, the latch being rigidly affixed to the connecting rod generally medially thereto;

a lock plate, the lock plate having a substantially horizontal major plane and an inner edge, the lock plate selectively communicating with the latch;

a transversely disposed lock rod extending from the inner edge of the lock plate, the lock rod having a distal end opposite the lock plate; and a lock status indicator extending from the distal end of the lock rod, the lock status indicator having a substantially vertical major plane substantially orthogonal to the major planes of the actuator plates, the lock status indicator shifting in unison with the lock plate and indicating lock status accordingly.

14. The hands-free door latch mechanism according claim 13, further comprising:

wherein the at least one actuator plate is composed of mutually opposed, laterally disposed first and second actuator plates, the actuator plates having vertically oriented major planes, the planes being mutually coplanar; and wherein the at least one arm is composed of a first arm and a second arm extending from the inboard edge of the respective first actuator plate and second actuator plate, the arms being parallel to one another, the connecting rod extending between the distal ends of the arms, the latch being attached to the connecting rod between the arms.

15. The hands-free door latch mechanism according claim 13, further comprising a mortise box, the inner end of the latch disposed within the mortise box.

16. The hands-free door latch mechanism according claim 13, wherein each actuator plate includes an outer edge portion opposite the inboard edge, each outer edge portion disposed at an angle to the major plane of the actuator plate.

17. A hands-free door latch mechanism, comprising:

at least one actuator plate;

wherein the at least one actuator plate includes first and second mutually opposed, and laterally disposed plates, the first and second actuator plates having inboard edges and vertically oriented major planes, the planes being mutually coplanar;

a first arm and a second arm extending from the inboard edge of the respective first actuator plate and second actuator plate, each arm having a distal end, the arms being parallel to one another; and a connecting rod extending transversely between the distal ends of the arms, the latch being attached to the connecting rod between the arms;

a latch connected to the actuator plate, the latch having a strike end and an inner end opposite the strike end;

a lock plate, the lock plate having a substantially horizontal major plane and an inner edge, the lock plate selectively communicating with the inner end of the latch;

a transversely disposed lock rod extending from the inner edge of the lock plate, the lock rod having a distal end opposite the lock plate; and a tang depending generally medially from the lock rod, the tang selectively engaging the inner end of the latch and preventing latch movement when the lock plate is shifted downward; and a mortise box, the inner end of the latch disposed within the mortise box.

18. The hands-free door latch mechanism according claim 17, further comprising a lock status indicator extending from the distal end of the lock rod, the lock status indicator having a substantially vertical major plane substantially orthogonal to the major planes of the actuator plates, the lock status indicator shifting in unison with the lock plate and indicating lock status accordingly.

19. The hands-free door latch mechanism according claim 17, wherein the first and second arms extend normal to the first and second actuator plates.

20. The hands-free door latch mechanism according claim 17, wherein each first and second actuator plate includes an outer edge portion opposite the inboard edge, each outer edge portion disposed at an angle to the major plane of the actuator plate.

* * * * *